US006393799B2

(12) United States Patent
Jenkins et al.

(10) Patent No.: US 6,393,799 B2
(45) Date of Patent: May 28, 2002

(54) COIN BOX CASSETTE LOADING SYSTEM

(76) Inventors: Stuart M. Jenkins, 105 Aldwick Road, Bognor Regis, West Sussex (GB), P021 2NY; Derek Haynes, 676 Thrush Ct., Marco Island, FL (US) 34145

( * ) Notice: Subject to any disclaimer, the term of this patent is extended or adjusted under 35 U.S.C. 154(b) by 0 days.

(21) Appl. No.: 09/756,948

(22) Filed: Jan. 9, 2001

Related U.S. Application Data

(60) Provisional application No. 60/175,250, filed on Jan. 10, 2000.

(51) Int. Cl.[7] ..... B65B 19/34
(52) U.S. Cl. ..... 53/148; 53/381.2; 414/412
(58) Field of Search ..... 53/147, 148, 284.5, 53/381.2, 443, 444, 448, 475; 221/197; 414/412

(56) References Cited

U.S. PATENT DOCUMENTS 3,842,573 A * 10/1974 Price ..... 53/148
4,324,523 A * 4/1982 Zablocky ..... 221/197
5,029,431 A * 7/1991 Weening et al. ..... 53/475
5,475,967 A * 12/1995 Levi ..... 53/381.2
5,657,615 A * 8/1997 Muller ..... 53/448
5,715,658 A * 2/1998 Citron et al. ..... 53/492
5,865,014 A * 2/1999 Citron et al. ..... 53/381.2
6,095,369 A * 8/2000 Jenkins et al. ..... 221/77

FOREIGN PATENT DOCUMENTS

EP 404272 * 12/1990 ..... 414/412

* cited by examiner

*Primary Examiner*—James W. Keenan
(74) *Attorney, Agent, or Firm*—John P. McGonagle

(57) ABSTRACT

A box opening machine adapted to opening a pre-packaged box containing coin rolls and emptying the coin rolls into a coin roll cassette. The invention provides a platform with a box slicer. The box is pushed over a platform work surface whereby the box bottom is sliced opened. The sliced box is then slid over a loading hopper wherein the box contents are emptied. The coin rolls from the box are then channeled into a coin roll cassette. The empty box is discarded.

7 Claims, 3 Drawing Sheets

COIN BOX CASSETTE LOADING SYSTEM

This application claims the benefit of provisional application 60/175,250, filed Jan. 10, 2000.

BACKGROUND OF THE INVENTION

This invention relates to a coin dispensing apparatus, and more particularly to a system for loading coin rolls into cassettes used within such apparatus.

Coin change is generally distributed in wrapped form. The wrapping can be either in paper or plastic film. The coin rolls are usually pre-packed in cardboard boxes of a known value. For example, U.S. quarter coins (25¢) are usually packed in boxes to a value of $500.00.

The business of counting, wrapping, boxing and distributing coins is a labor intensive process. While specialized labor and machines are available for the pre-packaging of coins, users of the coins are not specialists and the distribution process is quite burdensome.

SUMMARY OF THE INVENTION

The purpose of the present invention is to reduce the physical labor and cost of distributing coin rolls, especially in connection with the operation of coin roll dispensing machines, such as disclosed in Applicants' co-pending application, Ser. No. 09/084,159, riled May. 23,1998, "Coin Dispensing Apparatus", now U.S. Pat. No. 6,095,369, and incorporated herein by reference.

The present invention meets this purpose by providing a box opening machine which opens a pre-packaged box containing coin rolls and empties the coin rolls into a coin roll cassette. The invention provides a platform with a box slicer. The box is pushed over a platform work surface whereby the box bottom is sliced opened. The sliced box is then slid over a loading hopper wherein the box contents are emptied. The coin rolls from the box are then channeled into a coin roll cassette. The empty box is discarded.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 2:
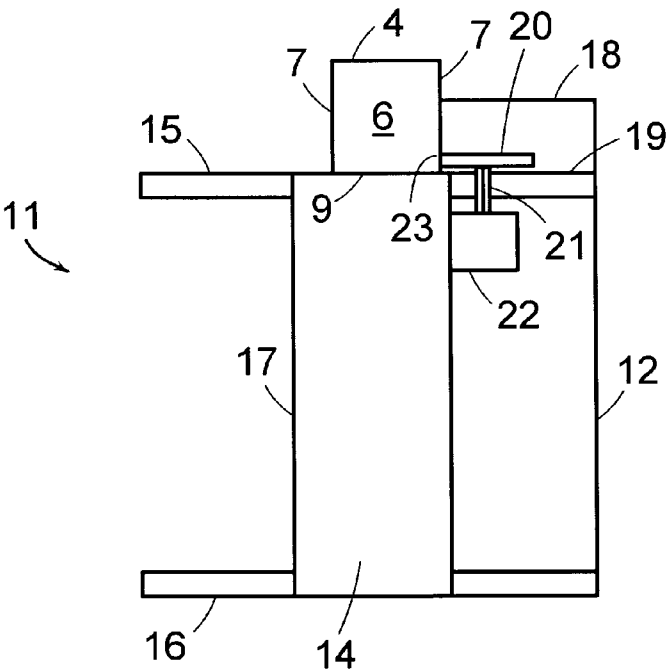
FIG. 2 is a side view of the apparatus of FIG. 1.

Referring to the drawings in detail wherein like elements are indicated by like numerals, there is shown a coin box cassette loading system 1 comprised of two major subsystems, a box opening apparatus 10 and a cassette loader 30.

The box opening apparatus 10 has a front 11, rear 12, left side 13, right side 14, top 15 and bottom 16. The top 15 and bottom 16 are generally horizontal, planar platforms interconnected by it vertical support structure 17. The vertical support structure 17 may be height adjustable. The top platform 15 has an elongated rectangular housing 18 mounted along the platform rear 12 said housing 18 covering a nominal rear portion 19 of the top platform 15.

The box opening apparatus 10 is further comprised of a circular slitting blade 20 attached to a shaft element 21 driven by a motor 22. The shaft element 21 is attached to the top platform rear portion 19 and positioned vertically so that the motor 22 is positioned below the top platform 15 and the slitting blade 20 positioned above the top platform 15. The shaft element 21 is further positioned in the top platform rear portion 19 so that a front portion 23 of the slitting blade 20 protrudes just out of the top platform rear portion 19 toward the apparatus front 11. The housing 18 covers most of the slitting blade 20. The housing 18 has a front opening 24 through which the slitting blade front portion 23 protrudes.

Coin roll boxes 4 have generally rectangular shapes and generally have flaps 5 along each of the short sides 6 and a bottom 9 attached along each long side 7. The coin rolls 2 are packaged within the box 4 so that each roll 2 is parallel with the short sides 6 and bottom 9. In operation a coin roll box 4 loaded with coin rolls 2 5s placed on the box opening apparatus top platform 15, with a box long side 7 against the housing 18. The box 4 is positioned onto the top platform 15 from the right side 14 and pushed toward the left side 13. A box junction comprised of a bottom 9 and a long side 7 engages the slitting blade front blade portion 23, thereby cutting the bottom 9 from the box 4.

The cassette loader 30 is a generally rectangular, hollow container having a top 31, bottom 32, right side 33, left side 34, open front 35, closed rear 36 and an interior 37 defined by said top 31, bottom 32, sides 33, 34, front 35 and rear 36. The cassette loader sides 33, 34 define a loader longitudinal axis. A wedge-shaped platform 38 is positioned within the loader interior 35, said platform 38 having a width equal to the width of the sides 33, 34 and beginning at the left side 34 near to the top 31 and extending downward to a junction formed by the bottom 32 and right side 33.

Mounted on the loader top 30 is a coin roll holding area, i.e., a loading hopper 40, defined by a left side flange 41 and a right side flange 42. The separation between the flanges 41, 42 is slightly larger than the longitudinal length of a box 4 of coin rolls 2. The cassette loader top 31 has an opening 43 to the interior 37 adjacent the left side 34. A horizontal roller 39 is attached to the loader rear 36, said roller extending to the front 35 and being parallel to the bottom 32 and sides 33, 34 and being perpendicular to the rear 36. The roller 39 is positioned near to the top 31 adjacent to and on the right side of the opening 43. A loader throat 44 is formed by the opening 43 and a space between the roller 39 and the left side 34.

Each coin roll cassette 50 is loaded from an open end 51. Each cassette 50 has spring-loaded pusher 52 providing relatively mild resistance to the coin rolls 2 being inserted into the cassette open end 51. For the loading process, a cassette 50 is positioned on the wedge platform 38 with the cassette open end 51 adjacent the throat 44. The throat 44 may have a curved element 45 attached to the eft side 34 above the platform 38 to smooth out the flow of coin rolls 2 from the loading hopper 40 through the throat 44 into the cassette open end 51.

Figure 1:
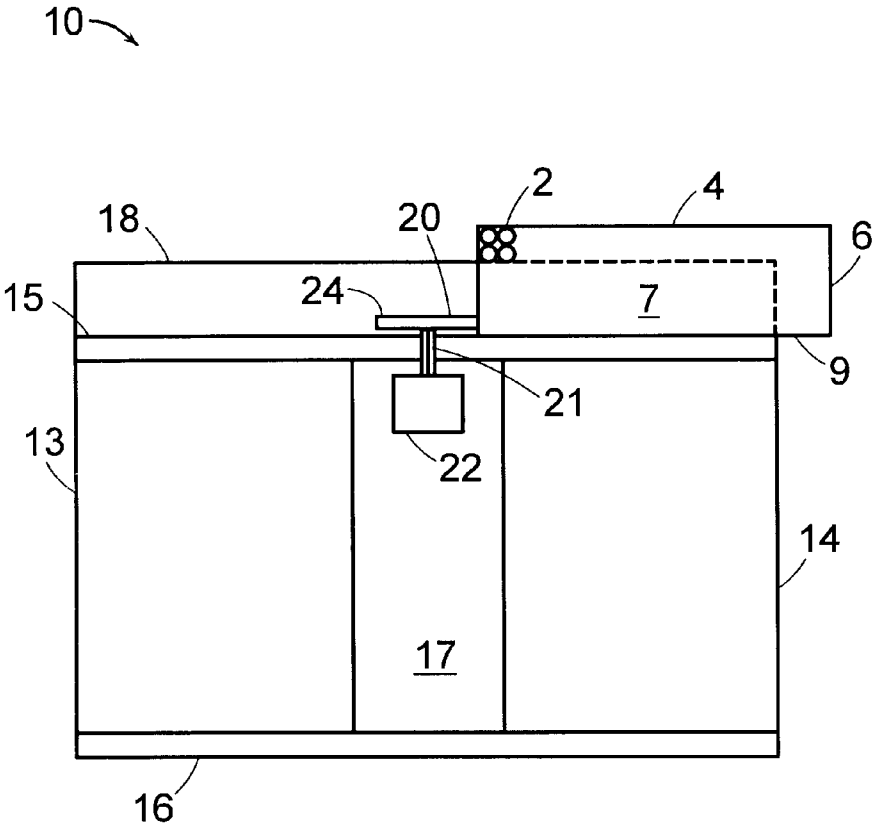
FIG. 1 is a front view of the box opening apparatus.
Figure 3:
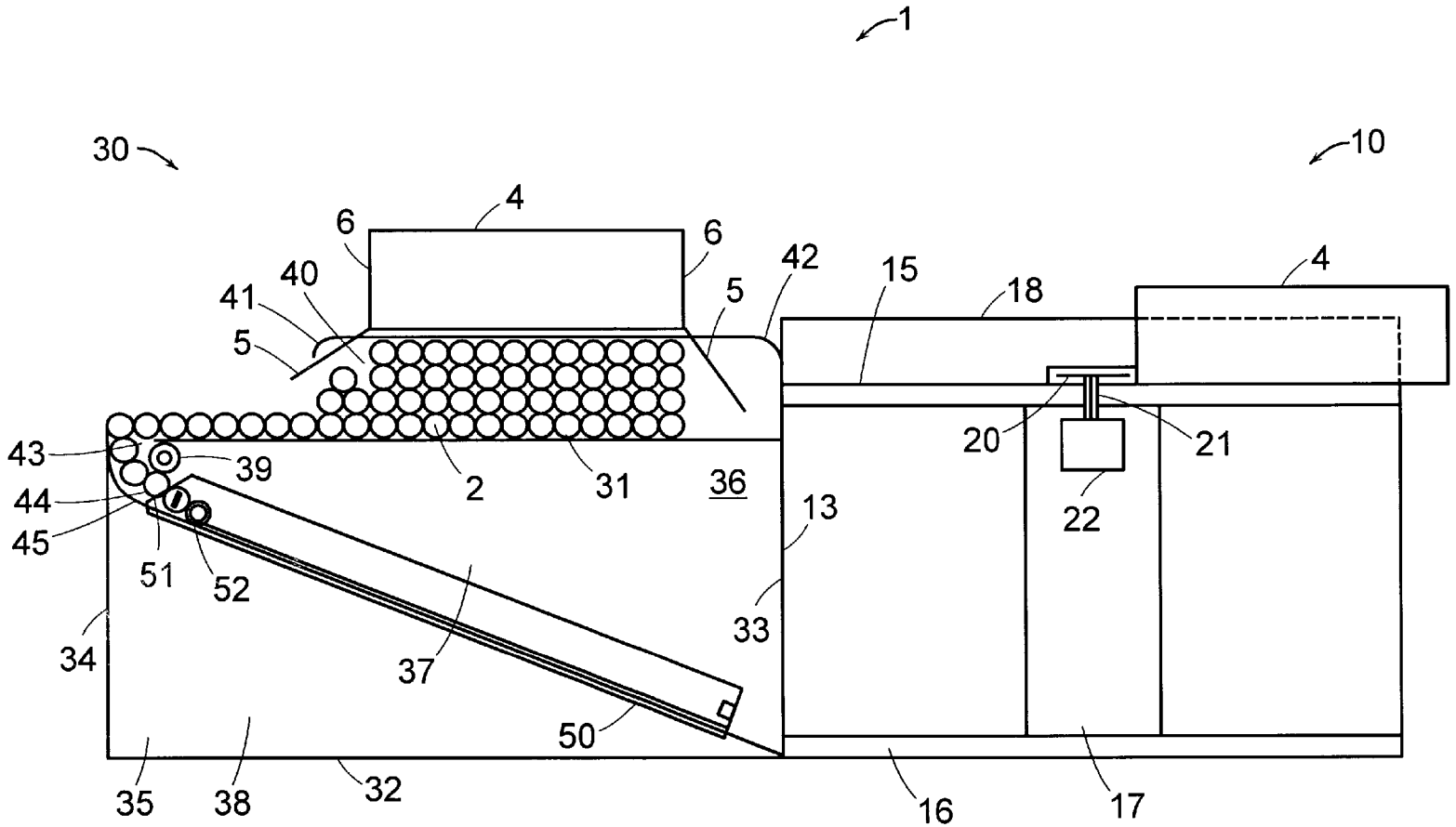
FIG. 3 is a front view of the cassette loader in conjunction with the box opening apparatus of FIG. 1.
Figure 4:
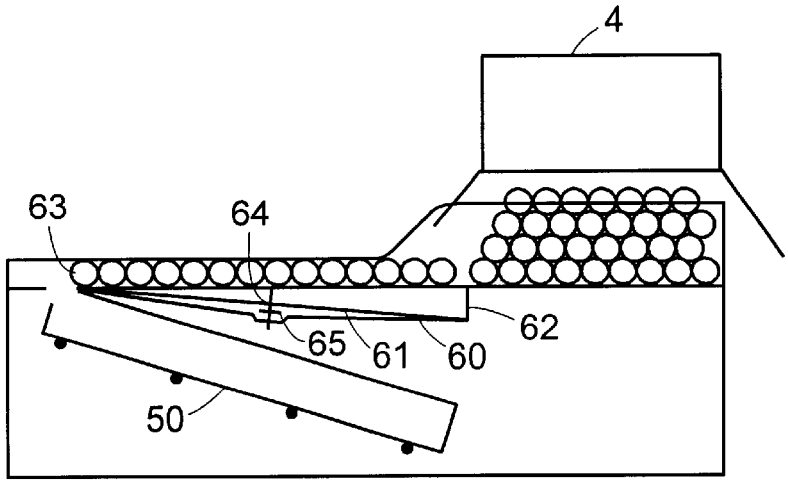
FIG. 4 is a side view of an alternate embodiment of the cassette loader.
Figure 5:
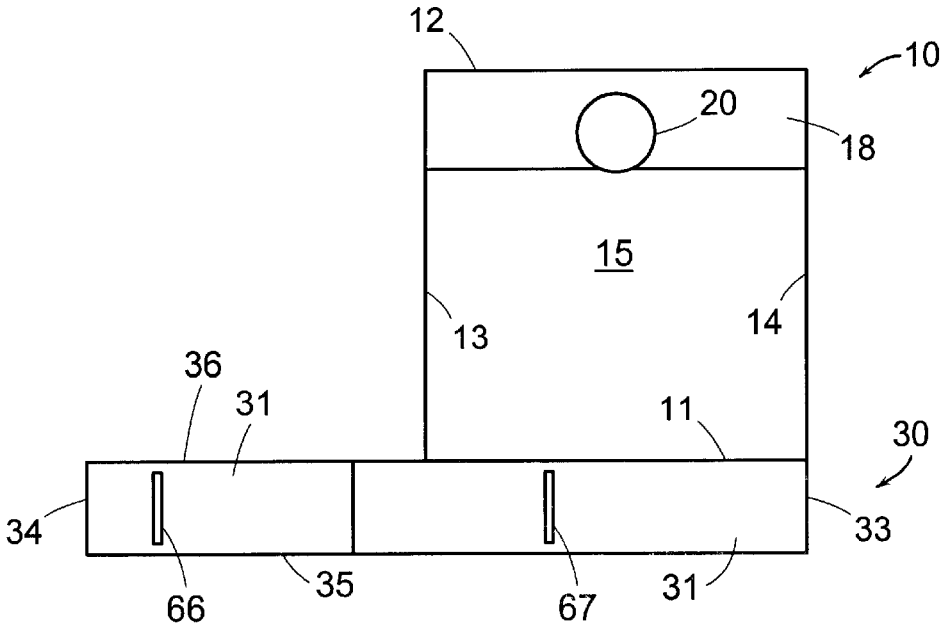
FIG. 5 is a top view of the cassette loader of FIG. 4 in conjunction with the box opening apparatus.

In an alternate embodiment of the invention shown in FIGS. 4 and 5, the cassette loader 30 is elongated to accommodate a pivoting lever 60, which is used to gauge the number of coin rolls relative to a full cassette 50. The pivoting lever 60 will work for any coin diameter since the cassette length is always constant. The cassette loader 30 position relative to the box opening apparatus 10 is changed to the box opening apparatus front 11 and not the side 13 as shown in FIGS. 1 through 3. The loading hopper 40 and cassette loader 30 remain essentially the same.

The pivoting Sever 60 is comprised of an elongated, flat element 61 with two upwardly turned ends, a right end 62 and a left end 63 , said ends defining the longitudinal axis of the lever 60, said longitudinal axis generally coincident with the longitudinal axis of the cassette loader 30. The pivoting lever 60 has a pivot point 64 at a selected positioned along the longitudinal axis of the elongated element 61. Said pivoting lever elongated element 61 pivotally joined to a pivot element 65 at said pivot point 64. The pivot element 65 is fixedly joined to the cassette loader rear 36 in the loader interior 37 near to the loader top 31. Two open, parallel slits are formed in the loader top 31, a left slit 66 and a right slit 67, each said slit having longitudinal axis transverse to the longitudinal axis of the loader 30. The pivoting lever ends 62, 63 are adapted to fit through the slits 66, 67.

In operation, a box 4 with a slit junction bottom 9 and long side 7 is slid from the box opening apparatus top platform 15 into the cassette loader loading hopper 40. When the box 4 is lifted clear the coin rolls 2 remain in the hopper 40. The box flaps lift clear when the box 4 is removed from the hopper 40. If a portion of the box 4 remains under the coin rolls 2, it can be removed later. The coin rolls 2 from the box enter the loader throat 44 and into the cassette 50. A retaining stick (not shown) is then pushed through an aperture (not shown) in the cassette 50 to retain the coin rolls 2 and allow a full cassette 50 to be removed and allow an empty cassette 50 to be inserted into the cassette loader 30. The operation is then repeated on a continuous basis.

In the embodiment of the invention with a pivoting lever 60, the elongated element left end 63 protrudes through the left slit 66. Before any coin rolls reach the opening 43, the protruding left end 63 halts the flow of coin rolls to the opening 43. The pivoting lever 60 is then activated, either manually of automatically, to pivot bringing the elongated element right end 62 protrudes through the right slit 67. This causes the left end 63 to recede through the left slit 66, thereby releasing the coin rolls 2 to the opening 43. The protruding right end 62 halts the flow of additional coin rolls to the opening 43. The pivoting lever 60 thereby gauges the number of coin rolls 2 needed to fill a cassette 50.

It is understood that the above-described embodiment is merely illustrative of the application. Other embodiments may be readily devised by those skilled in the art which will embody the principles of the Invention and fall within the spirit and scope thereof.

We claim:

1. A coin box cassette loading system adapted to open a pre-packaged box containing coin rolls and empty the coin rolls into a coin roll cassette, said coin roll boxes having generally rectangular shapes, said coin rolls being packaged within the box so that each roll's longitudinal axis is transverse to the longitudinal axis of a box, comprising:

a box opening apparatus having a front, rear, two opposite sides, top and bottom, said top and bottom being generally horizontal, planar platforms interconnected by a vertical support structure;

a circular slitting blade attached to a shaft element driven by a motor, said shaft element being attached to the box opening apparatus top platform rear portion and positioned vertically so that the motor is positioned below the top platform and the slitting blade positioned above the top platform, said shaft element being further positioned in the top platform rear portion so that a front portion of the slitting blade protrudes out of the top platform rear portion toward the apparatus front; and a cassette loader comprised of:

a generally rectangular, hollow container having a top, bottom, first side, second side, open front, closed rear and an interior defined by said top, bottom, sides, front and rear, said top having an opening to the interior adjacent the first side, said sides defining a longitudinal loader axis;

a wedge-shaped platform positioned within the loader container interior, said platform having a width equal to the width of the sides and beginning at the first side near to the top and extending downward to a junction formed by the loader container bottom and the second side;

a coin roll holding area comprised of a loading hopper, mounted on the loader container top, said hopper being defined by a first side flange and a second side flange, said flanges having a separation slightly larger than a longitudinal length of a box of coin rolls;

a horizontal roller attached to the loader container rear, said roller extending to the front and being parallel to the bottom and sides and being perpendicular to the rear, said roller being positioned near to the top adjacent to and on one side of the loader container opening, said loader container opening, first side and roller forming a loader throat;

wherein a coin roll cassette is positioned on the wedge platform with the cassette having an open end adjacent the loader throat.

2. A loading system as recited in claim 1, further comprising:

an elongated rectangular housing mounted on the box opening apparatus top platform along the apparatus rear, said housing covering a nominal rear portion of the top platform.

3. A loading system as recited in claim 2, wherein:

the housing is positioned over a substantial portion of the slitting blade, said housing having a front opening through which the slitting blade front portion protrudes.

4. A loading system as recited in claim 3, further comprising:

a height adjustable vertical support structure.

5. A loading system as recited in claim 4, further comprising:

a curved element within said loader throat, said element being attached to the first side above the platform.

6. A loading system as recited in claim 5, wherein said cassette loader is further comprised of:

a pivoting lever comprised of an elongated element with two upwardly turned ends, a first end and a second end, said ends defining a longitudinal axis of the lever, said longitudinal axis generally coincident with the longitudinal axis of the cassette loader, said pivoting lever having a pivot point at a selected positioned along the longitudinal axis of the elongated element;

a pivot element fixedly joined to the cassette loader rear in the loader interior near to the loader top, said pivoting lever elongated element being pivotally joined to said pivot element at said pivot point;

two open, parallel slits formed in the loader top, a first slit and a second slit, each said slit having a longitudinal axis transverse to the longitudinal axis of the loader, wherein said pivoting lever ends are adapted to fit through the slits.

7. A loading system as recited in claim 6, wherein:

said pivoting lever is adapted to being pivoted whereby said elongated element first end protrudes through said first slit;

said pivoting lever is adapted to being pivoted whereby said elongated element second end protrudes through said second slit and said elongated element first end is withdrawn from said first slit.

* * * * *